US005529273A

United States Patent [19]

Benthin

[11] Patent Number: 5,529,273

[45] Date of Patent: Jun. 25, 1996

[54] MOUNTING BRACKET

[76] Inventor: Siegfried Benthin, D-27574, Bremerhaven, Germany

[21] Appl. No.: 293,017

[22] Filed: Aug. 19, 1994

[51] Int. Cl.[6] ..... A47H 1/14

[52] U.S. Cl. ..... 248/254; 160/902; 248/222.52; 248/262

[58] Field of Search ..... 248/254, 257, 248/262, 265, 298, 320, 220.21, 220.22, 222.52; 160/330, 345, 902

[56] References Cited

U.S. PATENT DOCUMENTS

| | | | |
|---|---|---|---|
| 2,590,030 | 3/1952 | Obert | 248/222.3 X |
| 2,914,286 | 11/1959 | Weaver | 248/265 |
| 3,030,060 | 4/1962 | Breuer | 248/265 |
| 3,120,940 | 2/1964 | Del Faro et al. | 248/265 X |
| 3,567,261 | 3/1971 | Akczinski | 248/265 X |
| 4,179,091 | 12/1979 | Bidney | 248/265 |
| 4,363,459 | 12/1982 | Holzer | 248/257 X |
| 5,012,850 | 5/1991 | Schrader | 160/902 X |
| 5,044,589 | 9/1991 | Milne et al. | 248/265 |
| 5,060,710 | 10/1991 | Haarer | 160/902 X |
| 5,131,616 | 7/1992 | Biba | 248/265 |

*Primary Examiner*—Alvin C. Chin-Shue
*Assistant Examiner*—Derek J. Berger

[57] ABSTRACT

A mounting bracket wherein a base (12) is secured to an arm (20) by a fastener (22). A cam post (28) has a head (30) that is connected to arm (20) by a shaft (32). A spring clip (34) has an aperture (40) that is contoured in correspondence with head (30) and is retained between head (30) and arm (20) at selected angular positions about cam post (28).

5 Claims, 3 Drawing Sheets

MOUNTING BRACKET

BACKGROUND OF THE INVENTION

1. Field of the Invention

The subject invention is directed to devices for mounting window and door coverings and, more particularly, to brackets for mounting curtain rods and blind tracs.

2. Description of the Prior Art

In the prior art, coverings for windows and doors are hung from various type of transverse rods and tracs. In turn, a wide variety of hangers and brackets are used to mount these rods and tracs to walls and other structures. It was advantageous that these brackets incorporate mechanical adjustments that allow them to fit a broad range of structural applications as well as the wide range of different rods and tracs.

Adjustable brackets for curtain rods and the like are known in the prior art. Some brackets such as shown in U.S. Pat. Nos. 2,914,286; 3,567,261; 3,120,940; and 3,030,060 are designed to slideably extend from the wall. Other brackets such as shown in U.S. Pat. No. 4, 179,091 are further designed to be adjustable in the vertical direction.

The prior art also incorporates various mechanisms for securing the rod or trac to the bracket. In some cases, cam arrangements such as shown in U.S. Pat. Nos. 3,030,060 and 4,179,091 were used. Where brackets are used to suspend tracs, a spring clip typically engages the trac and the spring clip is then secured to the bracket. The mechanisms for mounting the spring clip include screws, rivets and undercarriage structure as shown in U.S. Pat. Nos. 4,363,459; 5,044,589; and 5,131,616. The spring clips are specifically shaped to engage the particular trac for which they are designed.

One difficulty with the prior art arrangements has been that the use of a spring clip is generally limited to a particular trac because the shape that is required for the spring clips is determined by the shape of the trac. Even In designs where the spring clip is removably fastened to the bracket such as by screws or equivalent means, the attachment or substitution of the spring clip has been a time consuming process. Moreover, securing or substituting the spring clip after the brackets are secured to the wall surface often requires the use of both hands, making it an awkward and somewhat difficult to do while standing on a ladder with one hand holding the bracket in position.

Therefore, there was a need in the prior art for a bracket that was readily adaptable to support a variety of tracs. In addition, there was a need for a bracket for which the spring clips could be easily and quickly attached, preferably with the use of only one hand.

SUMMARY OF THE INVENTION

In accordance with the subject invention, a bracket for supporting a transverse support member includes a base and an arm that is extendibly connected to the base. A fastener secures the arm in fixed relationship to the base. A cam post has one end that is secured to the ann and an opposite end that includes a head. The head is spaced apart from the arm and has a non-circular shape.

A clip is contoured to engage the traverse support member and is provided with an aperture that is contoured such that the head will pass through the aperture clip at times when the clip is at a first angular position with respect to head of said cam post, but the head will not pass through the aperture at times when the clip is at a second angular position with respect to the head of said cam post.

Preferably, cam post includes a shaft and a head, with the head being connected to the shaft and spaced apart from the arm by the shaft. The aperture in the clip and the cross-section of the shaft are dimensioned such that the clip is rotatable on the shaft when the shaft extends through the aperture.

Most preferably, the cross-section of the head parallel to said arm defines a profile of the head that is elliptical.

Other details, objects and advantages of the present invention will become apparent as the following description of the presently p,referred embodiment proceeds.

BRIEF DESCRIPTION OF THE DRAWINGS

The accompanying drawings illustrate a preferred embodiment of the invention wherein.

PREFERRED EMBODIMENT OF THE SUBJECT INVENTION

Figure 1:
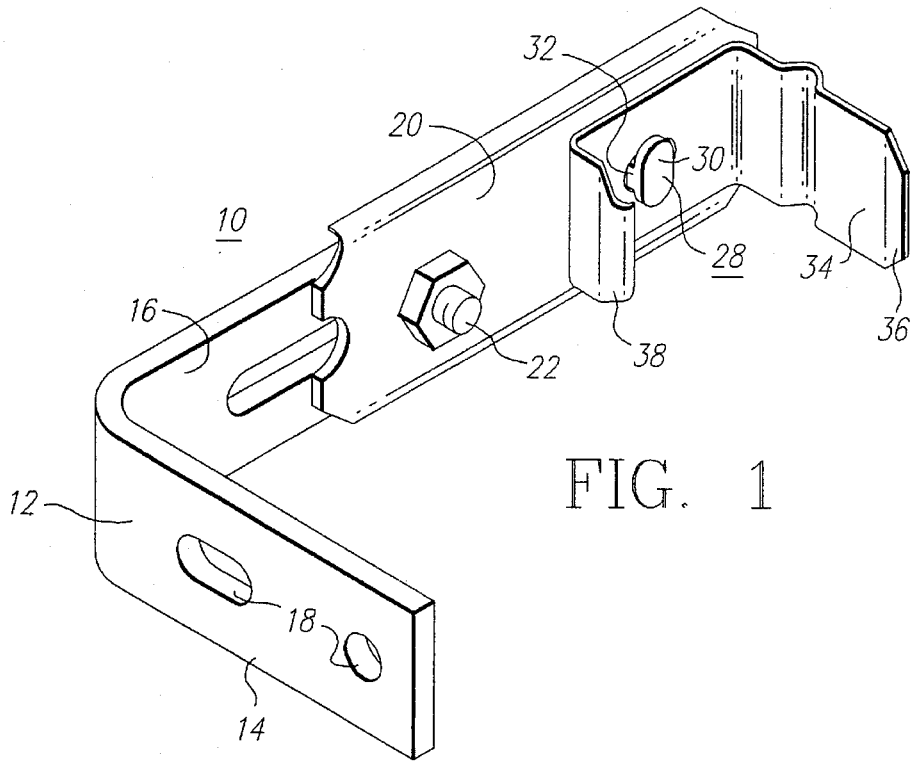
FIG. 1 is an orthogonal view of a support bracket in accordance with the subject invention.
Figure 2:
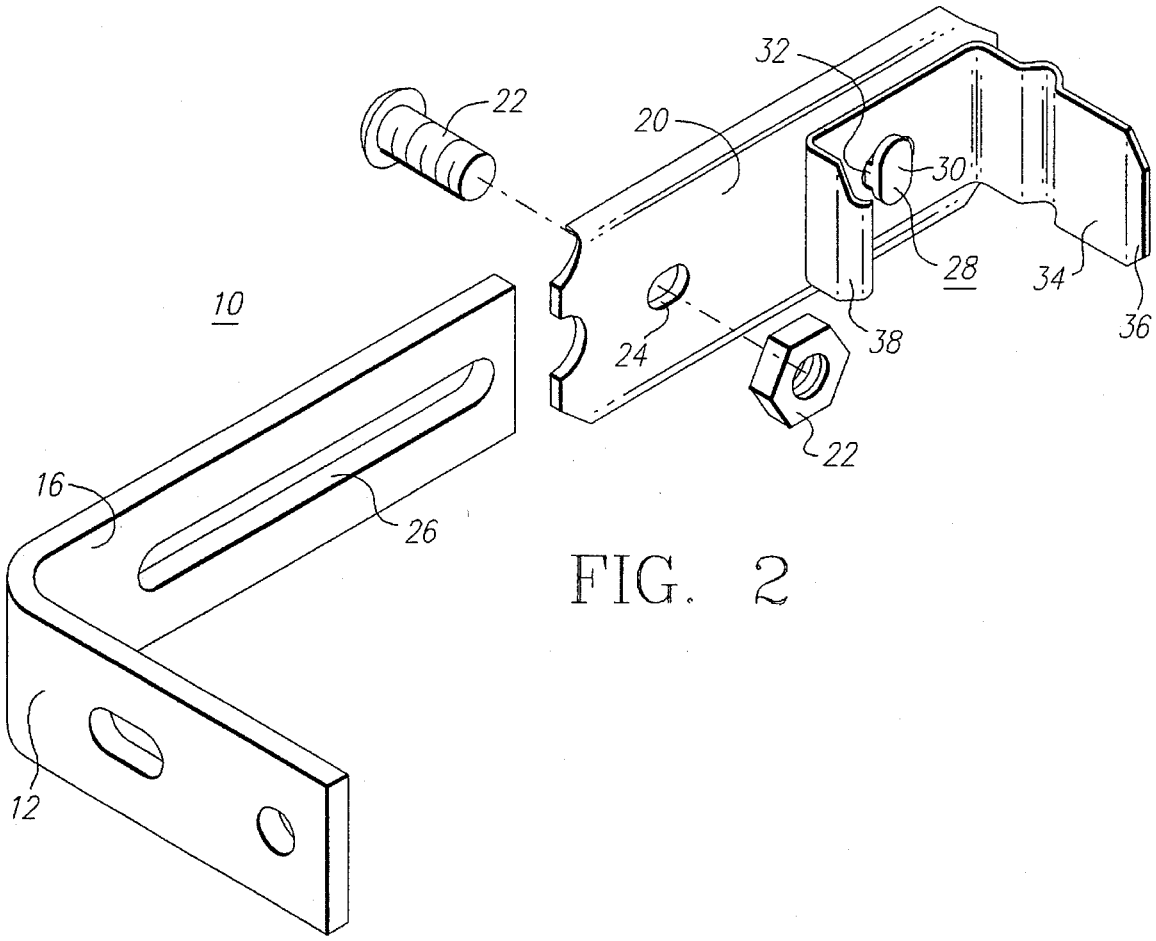
FIG. 2 is a view of the subject invention wherein the arm of the mounting bracket is disassembled from the base.

A presently preferred embodiment of the subject invention is shown in FIG. 1 wherein a bracket 10 includes a base 12 that has a vertical leg 14 and a horizontal leg 16. Vertical leg 14 is provided with holes 18 for receiving screws or other fasteners (not shown) by which base 12 of bracket 10 can be mounted to a wall or other appropriate structural member.

Bracket 10 further includes an arm 20 that is connected in sliding engagement with horizontal leg 16 of base 12 by a fastener 22. Arm 20 has a hole 24 and horizontal leg 16 of base 12 has a slot 26 that receives fastener 22 such that arm 20 is secured to leg 16 at times when fastener 22 is tightened to compress arm 20 against leg 16. At times when arm 20 is not compressed against leg 16, arm 20 is slideably engaged with leg 16 such that arm 20 can be extended or retracted along the longitudinal axis of slot 26 with the range of motion of arm 20 being determined by the length of slot 26. To facilitate such adjustments, fastener 22 can include a wing nut so that it can be tightened and released without tools.

Figure 3:
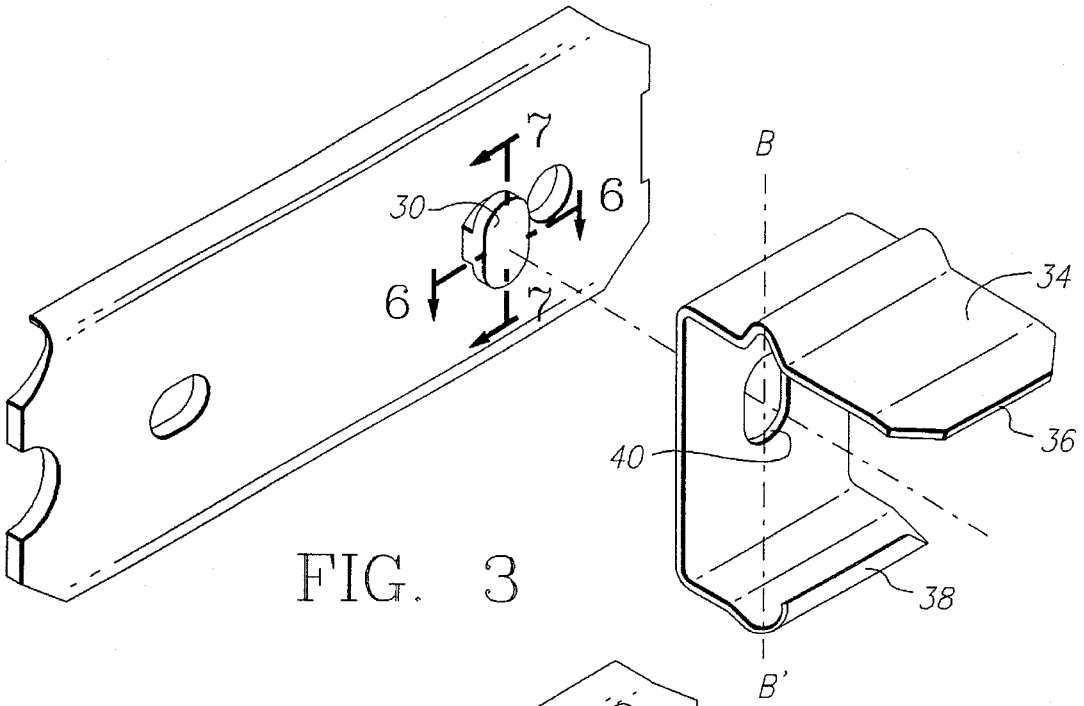
FIG. 3 is an exploded orthogonal view of the arm and clip of a support bracket in accordance with the present invention.
Figure 6:
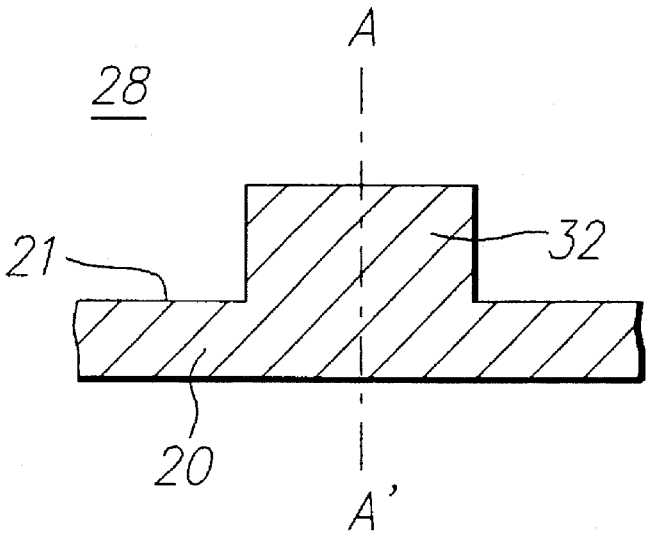
FIG. 6 is a cross-sectional view of the cam post shown in FIG. 3 taken along the lines 6—6.
Figure 7:
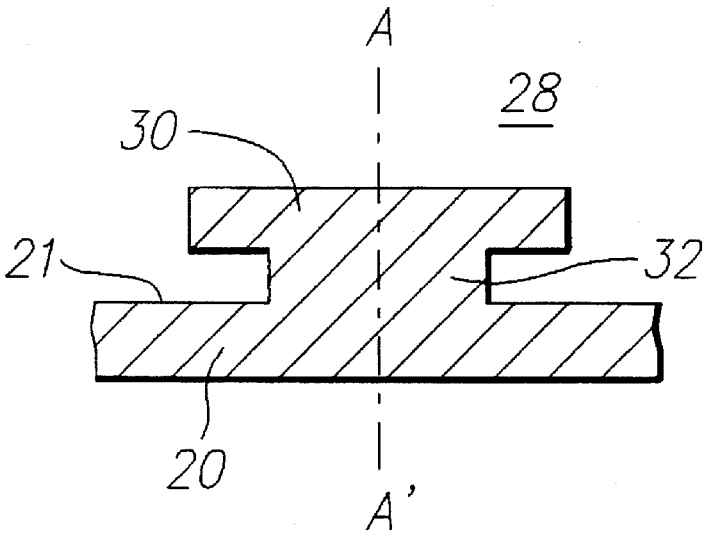
FIG. 7 is a cross-sectional view of the cam post shown in FIG. 3 taken along the lines 7—7 in FIG. 3.

As shown more particularly in FIGS. 3, 6 and 7, the bracket herein disclosed further includes a cam post 28 that is secured to ann 20 in fixed relationship. Cam post 28 includes a head 30 that is connected to a shaft 32. Shaft 32 is secured in fixed relationship to arm 20 and head 30 such that head 30 is maintained in spaced-apart relationship from arm 20. In a direction that is substantially normal to the surface 21 of arm 20, head 30 defines a non-circular profile. In the preferred embodiment, the non-circular profile is a substantially elliptical profile shape.

Referring to FIG. 1, bracket 10 further includes a spring clip 34 that is shaped to engage the traverse rod (not shown) that supports the covering for the window or door. Clip 34 is comprised of a strong resilient material such as spring steel or the equivalent such that terminal ends or tongs 36 and 38 of clip 34 can be temporarily deflected apart to allow portions of the traverse rod to pass therebetween. Tongs 36 and 38 are resilient in that when deflecting forces against them are relaxed, tongs 36 and 38 tend to return to their original respective positions so as to engage predetermined portions of the traverse rod.

Figure 4:
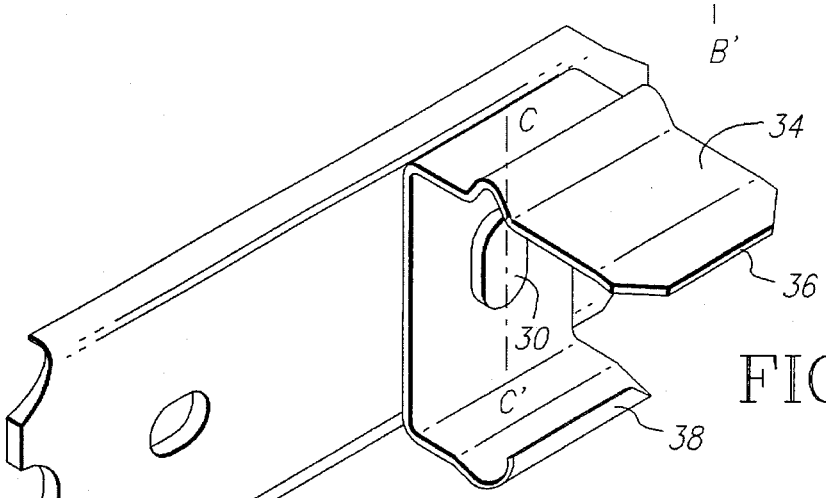
FIG. 4 shows an assembled view of the ann and clip of FIG. 3 with the aperture of the clip in registry with the profile of the cam head.
Figure 5:
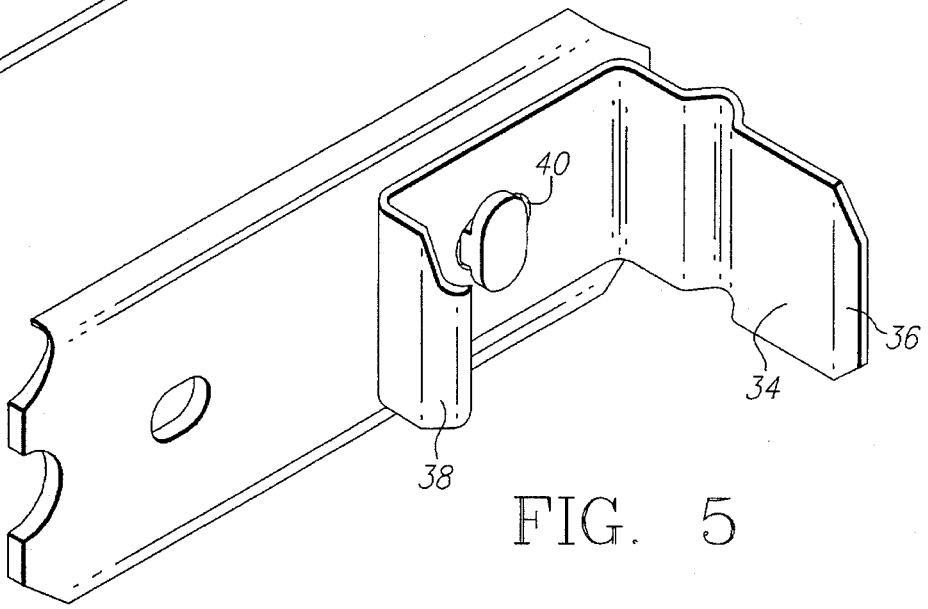
FIG. 5 shows an assembled view of the ann and clip of FIGS. 3 and 4 but with the clip rotated to a different angular position about the cam post.

Referring particularly to FIGS. 3, 4 and 5, clip 34 includes an aperture 40 have a non-circular shape. Aperture 40 is contoured in correspondence with the profile shape of head 30 of cam post 28. In addition, aperture 40 is sized to allow head 30 to pass through aperture 40 when the angular position of clip 34 with respect to head 30 of cam post 28 places the contour of aperture 40 in registry with the profile of head 30. At times when the angular position of clip 34 with respect to head 30 does not place the contour of aperture 40 in registry with the profile of head 30, head 30 will not pass through aperture 40. Also, aperture 40 is sized to allow shaft 32 to extend freely through aperture 40 such that clip 34 can be freely rotated on shaft 32. Thus, when clip 34 is in an angular position such that aperture 40 is in registry with head 30 as shown in FIG. 3, clip 34 can be passed over head 30 as is shown in FIG. 4. Then, as shown in FIG. 5, clip 34 can be rotated to a different angular position such that clip 34 will no longer pass over head 30. In this position, clip 34 is retained along shaft 32 between head 30 and arm 20.

Accordingly, the structure of cam post 28 and clip 34 allows clip 34 to be manually secured to cam post 28 without special tools by manually aligning aperture 40 with head 30 with clip 34 at a given angular position such that the contour of aperture 40 is in registry with the profile of head 30. Clip 34 is then placed over head 30 and rotated to a different angular position at which the profile of head 30 is no longer in registry with aperture 40.

In the particular example of the preference embodiment, the profile of head 30 and the contour of aperture 40 have corresponding elliptical shapes. The orientation of aperture 40 on clip 34 is such that the major axis B—B' of the ellipse is directed between tongs 36 and 38. With arm 20 secured to base 12 by fastener 22, head 30 of cam post 28 is oriented such that the major axis C—C' of the profile ellipse of head 30 is directed normally with respect to legs 14 and 16 of base 12. In this way, after clip 34 is placed over head 30 rotating clip 34 by an angular position of 90° will position clip 34 to be retained between head 30 and arm 20. Also at that position, clip 34 will be properly aligned so that tongs 36 and 38 can clasp the traverse support member in cooperation with additional brackets that are positioned at other locations. Thus, a plurality of clips 34 can be attached to a corresponding plurality of arms 20 without tools and with the use of one hand.

While a presently preferred embodiment of the invention disclosed herein has been shown and described, the invention is not limited thereto, but may be otherwise embodied within the scope of the following claims.

We claim:

1. A bracket for supporting a transverse support member, said bracket comprising:

a base;

an arm that is extendibly connected to said base;

a fastener for securing said arm in fixed relationship to said base;

a cam post that is secured to a surface of said arm, said cam post having a head that is spaced apart from said arm and that defines a non-circular profile in a direction that is normal to the surface of said arm; and a clip that is shaped to engage said transverse support member, said clip having a non-circular aperture that is contoured in correspondence with the profile of the head of said cam post such that the head passes through said aperture when said clip is in a given angular orientation with respect to said arm such that the contour of said aperture is in registry with the profile of said head, and such that said clip is retained between the head and the arm when said clip is at angular orientation with respect to said arm in which the contour of the aperture is not in registry with the profile of the head.

2. The bracket of claim 1 wherein said cam post comprises:

a head having a generally non-circular contour; and a shaft that is connected to said head and that spaces said head apart from said arm, said shaft being dimensioned such that the cross-sectional area of said shaft is less than the cross-sectional area of said head.

3. The bracket of claim 2 wherein said shaft is dimensioned such that said clip is rotatable about said shaft when said shaft extends through the aperture in said clip.

4. The bracket of claim 3 wherein said shaft has a substantially circular cross-sectional shape.

5. The bracket of claim 4 wherein a cross-section of said head in a plane substantially parallel to said arm is substantially in the shape of an ellipse.

* * * * *